United States Patent [19]

Jett, Jr.

[11] Patent Number: 4,735,009

[45] Date of Patent: Apr. 5, 1988

[54] SMALL ARMS CALIBER REDUCING ADAPTOR KIT

[76] Inventor: Thomas M. Jett, Jr., P.O. Box 167-B, R.R. 3, Litchfield, Ill. 62056

[21] Appl. No.: 862,699

[22] Filed: May 13, 1986

[51] Int. Cl.[4] ..... F41C 21/10; F42B 8/00

[52] U.S. Cl. ..... 42/77; 102/446; 102/447

[58] Field of Search ..... 42/77; 102/446, 447

[56] References Cited

U.S. PATENT DOCUMENTS

| | | | |
|---|---|---|---|
| 3,060,856 | 10/1962 | Dunn | 102/447 |
| 3,124,889 | 3/1964 | Hellstrom | 42/77 X |
| 3,156,995 | 11/1964 | Mellor et al. | 42/77 |
| 4,123,866 | 11/1978 | Wiethoff | 42/77 |
| 4,304,061 | 12/1981 | Brouthers | 42/77 X |
| 4,361,093 | 11/1982 | Saxby | 42/77 X |
| 4,455,777 | 6/1984 | Callies | 42/77 X |
| 4,459,774 | 7/1984 | Ferretti | 42/77 |

FOREIGN PATENT DOCUMENTS

| | | | |
|---|---|---|---|
| 279655 | 3/1952 | Switzerland | 42/77 |
| 384058 | 12/1932 | United Kingdom | 42/77 |

*Primary Examiner*—Ted L. Parr

*Attorney, Agent, or Firm*—Polster, Polster and Lucchesi

[57] ABSTRACT

A small arms caliber reducing adaptor kit including a barrel liner and cartridge insert sized to be inserted into an original small arms barrel and an original cartridge chamber respectively, the barrel liner and cartridge insert having corresponding reduced bores with the bore of the cartridge insert having a nose opening for a pellet and a base opening for a primer - the kit further including a primer seating tool.

9 Claims, 1 Drawing Sheet

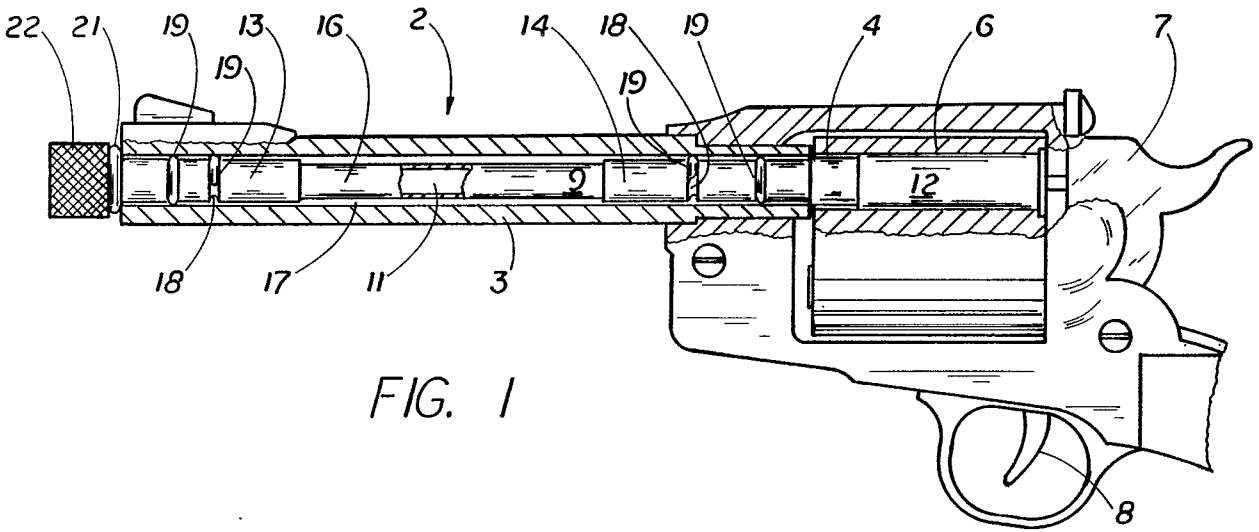
FIG. 1
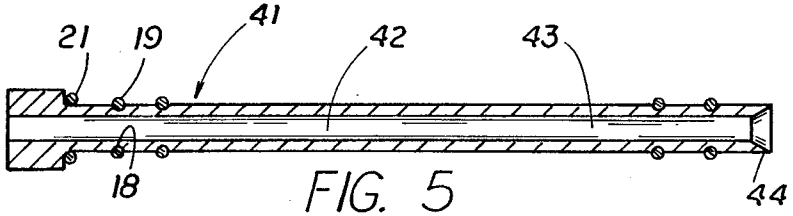
FIG. 5
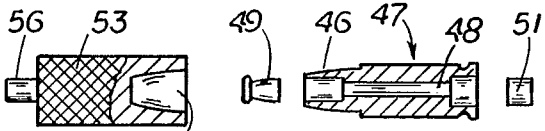
FIG. 6
FIG. 7
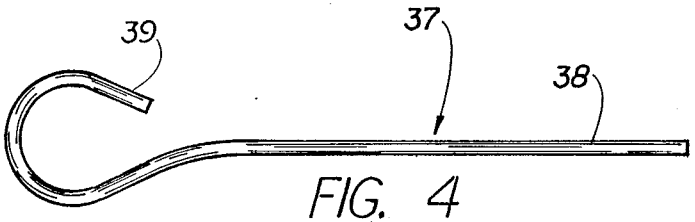
FIG. 4
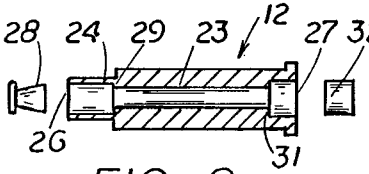
FIG. 2
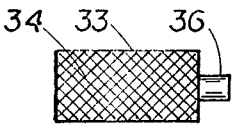
FIG. 3

SMALL ARMS CALIBER REDUCING ADAPTOR KIT

BACKGROUND OF THE INVENTION

The present invention relates to firearm structure and more particularly to a small arms caliber reducing adaptor kit for reducing the caliber of an original barrel and an original cartridge chamber of a small arms piece. The novel features of the structure of the present invention permit its effective and ready adaptation to various types of small firearms such as pistols, revolvers, automatics, rifles and life firearms.

It is known in the firearms art to convert a firearm having a particular barrel bore caliber to one having a smaller caliber and to substitute cartridge chambers to correspond with smaller caliber barrels. U.S. Pat. No. 4,455,777, issued to D. G. Callies on June 26, 1984, teaches converting an original firearm barrel by inserting a smaller caliber insert therein and inserting a cylinder insert into an original cylinder chamber between the substitute barrel and the powder-receiving compartment of the original cylinder chamber, thus avoiding the need for substituting cylinder chambers. The cylinder insert in the structure disclosed in the Callies patent has a caliber corresponding to that of the substitute barrel but is comparatively complex in mechanical design, manufacture and assembly, requiring several moveable parts to permit its insertion into the original cylinder between the substitute barrel and the powder-receiving compartment of the original cylinder. It also is generally well known in the firearms art to utilize the principle of reducing barrel and cylinder bore of firearms so that the explosive charge can be reduced to permit practice shooting, target shooting and training and at the same time minimize dangers. U.S. Pat. No. 4,361,093, issued to M. E. Saxby on Nov. 30, 1982, discloses such arrangement, the Saxby structure utilizing a removable two part cartridge insert reloadable from the base. Like the aforementioned patent to Callies, the cartridge insert disclosed by Saxby is comparatively complex in design, manufacture and assembly, requiring several moveable parts including at least one or alternatively two removable inserts into the main cartridge insert to permit missile loading and securing through the base of the main cartridge insert.

The present invention recognizing the importance and desirability of providing a small arms caliber reducing adaptor kit for barrel and cartridge chamber so as to permit both accurate and economical target and training practice provides a novel structure which is economical and straightforward in manufacture and assembly. In addition, the structure of the present invention requires a minimum of parts and inserts, can be readily adapted for use with various types of small arms and can be reused and recharged in an efficient and economical manner, regardless of the nature of the original barrel or cartridge chamber bore of the firearm with which it is to be used, requiring a minimum of adjustment for barrel lengths and allowing a minimum of undesirable metal-to-metal contact in assembly and operation.

Various other features of the present invention will become obvious to one skilled in the art upon reading the disclosure set forth herein.

SUMMARY OF THE INVENTION

More particularly, the present invention provides a small arms caliber reducing adaptor kit for reducing the caliber of the original barrel and original chamber of a small arms piece comprising: a barrel liner having a reduced caliber bore, the barrel liner being externally sized and adapted to be snugly inserted into the original barrel to extend in resilient sealed relation along the original length thereof; and a cartridge insert having a reduced caliber bore defined by the internal wall of the insert, the bore corresponding at least at its nose portion with the reduced caliber bore of the barrel liner, the cartridge insert being externally sized to be snugly inserted into the original cartridge chamber and to extend along the original length thereof to permit firing alignment of the reduced caliber bore of the cartridge insert with the reduced caliber bore of the barrel liner, the cartridge insert having a nose opening and a base opening at opposite ends of the reduced caliber bore; pellet means sized to snugly engage in the nose opening; and, primer means disposed in the base opening at the other end of the reduced caliber bore whereby firing of the primer means in the base opening impels the pellet means in the nose opening through the reduced caliber bore of the barrel liner. In addition, the present invention provides a novel primer seating tool including an external hand gripping surface and a cartridge insert steadying means at least at one end thereof to matingly hold the nose of the cartridge insert in steady position when a primer therefor is placed on a flat surface and pressed into sealed relation into the base opening at the opposite end of the cartridge insert.

BRIEF DESCRIPTION OF THE DRAWING

Referring to the drawing which discloses one advantageous embodiment of the present invention and several modifications thereof:

FIG. 1 is a side elevational view of a revolver disclosing certain of the component parts of the inventive small arms caliber reducing adapter kit disposed therein, two O-rings being omitted for purposes of illustration;

FIG. 2 is an exploded cross-sectional side view of a cartridge insert, pellet and primer of the type used in the revolver cartridge chamber of FIG. 1;

FIG. 3 is a side view of one type of primer seating tool usable with the cartridge insert disclosed in FIG. 2;

FIG. 4 is a side view of a decapping rod which can be used to remove exploded primers from cartridge inserts;

FIG. 5 is a cross-sectional view of a modified barrel liner for the inventive adaptor kit;

FIG. 6 is an exploded cross-sectional side view of a modified cartridge insert, pellet and primer used with the barrel liner of FIG. 5; and, FIG. 7 is a side view of another type of primer seating tool usable with the cartridge insert of FIG. 6.

DETAILED DESCRIPTION OF THE INVENTION

Referring to FIG. 1 of the drawings, a firearm in the form of a revolver 2 is disclosed, including an original barrel 3 and an original cartridge chamber 4 which is part of a revolving cartridge cylinder 6. A hammer 7 and a trigger mechanism 8 form part of the revolver frame, all as is well known in the firearm art. In this regard it is to be understood that the present invention is not to be considered as limited to the specific firearm disclosed but that the invention can be utilized with other types of known firearms such as pistols, automatics, rifles and like firearms.

In accordance with the present invention, a novel small arms caliber reducing adaptor kit for reducing the caliber of the original barrel 3 and original cartridge chamber 4 of revolver 2 is provided. The inventive kit includes a barrel liner 9 having a reduced caliber bore 11 and an appropriate number of cartridge inserts 12, only one such cartridge insert 12 being shown herein for the purposes of illustration. As disclosed in FIG. 1, the opposed ends 13 and 14 of barrel liner 9 are sized to be snugly inserted into the internal bore of original barrel 3 with liner 9 extending along the overall length of barrel 3. It is to be noted that the external diameter of barrel liner body 16 between opposed ends 12 and 13 thereof is reduced to provide a surrounding air cooling chamber 17 between the body of the barrel liner and the internal bore of barrel 3, serving to reduce weight and costs, as well as to reduce the occasion of metal-to-metal proximity with concommitant heat transfer therebetween during firing.

Opposed ends 13 and 14 of barrel liner 9 are each provided with two spaced peripheral grooves 18 which extend circumferentially around the periphery normal to the longitudinal axis of the liner. Each of these grooves 18 serves to receive an appropriately sized resilient, O-ring 19 to permit barrel liner 9 to sealingly engage in the interior wall or bore of original barrel 3, further reducing metal-to-metal contact between original barrel and caliber reducing liner. To even further reduce this metal-to-metal contact and to permit a certain amount of longitudinal size adjustment of barrel liner 9, a peripheral groove and O-ring 21 is provided adjacent knurled hand securing grip 22 integral with the outer end of barrel liner 9. O-ring 21 is of a greater diameter than the bore of original barrel 3, serving to keep grip 22 from engaging the barrel. It is to be understood that additional O-rings 21 or one with a thinner or thicker breadth can be provided to allow for appropriate longitudinal adjustments of liner 9 within the internal bore of original barrel 3. It further is to be understood, as will be obvious, that reduced caliber bore 11 of liner 9 extends through the grip end 22 to permit clear pellet passage therethrough.

In inserting barrel liner 9 into original barrel 3 it is desirable that the internal bore of barrel 3 be clean and properly lubricated. The O-rings 19 and 21 also should be lubricated. A heavier lubrication is generally required on initial liner insertion to permit the O-rings to seat in the barrel grooves. Excess lubrication should be cleared away after initial insertion and the liner reinserted until properly seated against the nose end of the cartridge insert 12 described hereinafter.

Referring to FIG. 2, cartridge insert 12 includes a reduced caliber bore 23, defined entirely by the internal wall of the cartridge insert with the bore at the nose portion 24 corresponding in size with the reduced caliber bore 11 of barrel liner 11. Cartridge insert 12 is externally sized to permit snug insertion into the original cartridge chamber 4 (FIG. 1). Cartridge insert 12 includes a nose opening 26 and a base opening 27 at opposite ends thereof. A suitable pellet 28 is provided, the pellet being sized to be snugly inserted through nose opening 26 with the rear skirt of the pellet 28 engaging against forward shoulder 29 defined by the larger bore of nose portion 24 and the narrower major body portion of reduced caliber bore 23. At the rear or aft end of reduced bore 23, there is a slight enlargement to provide an aft shoulder 31. A suitable primer 32 with an explosive substance therein is sized to snugly pass through base opening 27 with the forward portion of the primer engaging against shoulder 31.

To load primer 32 into the base opening 27 it only is necessary to lay the rear face of the primer on a flat surface, place the base opening 27 of cartridge insert 12 immediately thereabove in mating relation with the primer and press downwardly with the primer snugly passing through base opening 27 to seat against shoulder 31. Referring to FIG. 3, a suitable primer seating tool 33 can be provided to accomplish this. In the embodiment of FIG. 3, seating tool 33 includes an externally knurled hand gripping surface 34 and an insert steadying means in the form of a protruding extension 36 at one end thereof. Extension 36 is sized and shaped to conform with the internal bore at nose opening 26 to permit mating engagement and the steadying of the cartridge as primer 32 is pressed through base opening 27 to seat against aft shoulder 31.

Once the primer 32 is in place, pellet 28 can be inserted through nose opening 26 to seat against shoulder 29. Protruding extension 36 on tool 33 can be employed for this occasion to insure proper seating of the pellet.

When the cartridge insert 12 has been appropriately armed with pellet 28 and primer 32 snugly positioned at opposite ends of reduced internal bore 23, cartridge insert 12 can then be inserted for firing of primer 32 to impel the pellet 28 in the nose opening through the reduced caliber bore 11 of barrel liner 9.

To reload cartridge insert 12, a suitable decapping rod 37, including a shaft portion 38 and a hooked handle portion 39 can be inserted through the empty nose portion 24 of the cartridge to urge the spent primer shell from its seat 32 through base opening 27. The cartridge insert 12 can then once again be rearmed with a new pellet and primer.

Referring to FIGS. 5–7, a modified barrel liner 41 of substantially uniform thickness except for the peripheral grooves and O-rings is disclosed, the reduced body portion and air chamber of liner 9 of FIG. 1 having been eliminated. Further, in this embodiment of the invention, the reduced caliber bore 42 thereof has the rear or aft bore end 43, which is to be positioned adjacent the nose end of a cartridge insert, internally flared at 44 to matingly receive the externally tapered nose end 46 of cartridge insert 47. Internal bore 48 of cartridge insert 47 is provided with suitable openings and shoulders as aforedescribed for cartridge insert 12 to receive pellet 49 and primer 51.

The primer seating tool 53 of FIG. 7 differs from tool 33 of FIG. 3 in that it includes a cavity 54 at one end thereof which is sized to matingly conform with the external shape of tapered nose end 46 of cartridge insert 47 to permit mating steadying engagement therewith when primer 51 is loaded. A protruding extension 56 is provided at the other end of tool 53, the extension 56 being shaped and sized to conform with the nose opening of internal bore 48 of cartridge insert 47 to permit mating steadying engagement therewith for loading primer 51, if so elected, and to assist in loading pellet 49—all in a manner similar to that abovedescribed.

From the above description, it can readily be seen that the novel adaptor kit of the present invention is straightforward and economical in manufacture, design assembly and operation, enhancing the adaption of small firearms to a reduced caliber for accurate and economically efficient practice, target and training shooting. As aforementioned, various changes and material choices can be made in the several parts of the inventive kit by one skilled in the art without departing from the scope or spirit of the invention. For example, instead of peripheral grooves normal to the longitudinal axis of the liner with O-rings therein, the peripheral grooves in the liner could extend parallel the longitudinal axis of the liner with resilient strips inserted therein or the peripheral grooves and resilient strips therein could even be positioned to follow the course of rifling in the original barrel.

The invention claimed is:

1. A small arms caliber reducing adaptor kit for reducing the caliber of an original barrel and original cartridge chamber of a small arms piece comprising;

a barrel liner having a reduced caliber bore, said barrel liner being externally sized and fitted to be snugly inserted into the original barrel to extend along the original length thereof, and means for resiliently holding and sealing said liner in said original barrel when said barrel liner is inserted therein;

means for adjusting the barrel liner along the length of said original barrel so that said barrel liner conforms to the original length of said barrel without causing metal to metal contact between said barrel liner and said small arms piece;

a one piece cartridge insert having a reduced caliber bore defined by the internal wall of said insert, said bore corresponding at least at its nose portion with said reduced caliber bore of said barrel liner, said cartridge insert being externally sized for insertion into said original cartridge chamber to extend along the original length thereof and to permit firing alignment of the reduced caliber bore of the cartridge insert with the reduced caliber bore of said barrel liner, said cartridge insert having a nose opening and a base opening at opposite ends of said reduced caliber bore, projectile means inserted in said nose opening and sized to be engaged in said nose opening; and a primer means disposed in said base opening in the other end of said reduced caliber bore of said cartridge insert, whereby firing of the primer means positioned in said base opening of said cartridge insert impels the projectile means in said nose opening through the reduced caliber bore of said barrel liner.

2. The adaptor kit of claim 1 wherein said barrel liner further includes a pluraity of peripheral and circumferential grooves spaced along the external length of said barrel liner, and a plurality of resilient O-ring seals disposed in said spaced circumferential grooves to engage with the interior wall of said original barrel when said barrel liner is inserted therein, said O-ring seals mounting said barrel liner in said original barrel for use therewith.

3. The adapter kit of claim 2 wherein said barrel liner includes a handgrip to be positioned at the muzzle end of said original barrel, said means for adjusting the barrel liner comprising at least one resilient O-ring surrounding said barrel liner and having an external diameter larger than the diameter of the original barrel bore so as to be positioned between said handgrip and the muzzle end of said original barrel in the inserted position of said barrel liner.

4. The adaptor kit of claim 3 wherein said barrel liner has a reduced external diameter between the opposed ends of said original barrel to provide a surrounding air cooling chamber between the barrel liner and the original barrel bore of said small arms piece.

5. The adaptor kit of claim 4 wherein said reduced caliber bore in said cartridge insert includes an internal protrusion adjacent the nose opening to provide a seat for one end of said projectile means.

6. The adaptor kit of claim 4 wherein said reduced caliber bore in said cartridge insert includes a stepped shoulder portion adjacent said nose opening to provide a seat for an end of said projectile means.

7. The adaptor kit of claim 4 wherein said reduced caliber bore in said cartridge insert includes a stepped shoulder portion adjacent said base opening to provide a seat for the forward end of said primer means.

8. The adaptor kit of claim 3 wherein the reduced caliber bore in said cartridge insert includes an internal protrusion positioned near said base opening to provide a seat for the forward end of said primer means.

9. A small arms caliber reducing adapter kit for reducing the caliber of the original barrel and original cartridge chamber of a small arms piece comprising:

a barrel liner having a reduced caliber bore in comparision to the bore of said original barrel, said barrel liner being insertable into the original barrel to extend along at least the original length thereof;

means for resiliently holding said barrel liner in said original barrel when said barrel liner is inserted therein without metal contact between said barrel liner and said original barrel;

means for adjusting the barrel liner along the length of said original barrel so that said barrel liner conforms to the original length of said barrel without causing metal-to-metal contact between said barrel liner, said adjusting means, and said small arms piece; and a one-piece cartridge insert having a reduced caliber bore defined by an internal wall of said insert, said bore corresponding at least at its nose portion with the reduced caliber bore of said barrel liner, said cartridge insert being externally sized for insertion into said original cartridge chamber so as to extend along the original length thereof and to permit firing alignment of the reduced caliber bore of the cartirdge insert with the reduced caliber bore of said barrel liner, said cartridge insert having a nose opening and a base opening at opposite ends of said reduced caliber bore, projectile means inserted in said nose opening and sized to be engaged in said nose opening, primer means disposed in said base opening in the other end of said reduced caliber bore of said cartridge insert, whereby firing of the primer means positioned in said base opening of said cartridge insert impels the projectile means in the nose opening through said reduced caliber bore of said barrel liner.

* * * * *